US011703255B2

(12) United States Patent
Iijima

(10) Patent No.: US 11,703,255 B2
(45) Date of Patent: Jul. 18, 2023

(54) THERMOACOUSTIC REFRIGERATOR

(71) Applicant: SINTOKOGIO, LTD., Nagoya (JP)

(72) Inventor: Shinsuke Iijima, Nagoya (JP)

(73) Assignee: SINTOKOGIO, LTD., Aichi (JP)

( * ) Notice: Subject to any disclaimer, the term of this patent is extended or adjusted under 35 U.S.C. 154(b) by 212 days.

(21) Appl. No.: 17/356,921

(22) Filed: Jun. 24, 2021

(65) Prior Publication Data

US 2021/0404713 A1 Dec. 30, 2021

(30) Foreign Application Priority Data

Jun. 26, 2020 (JP) ..... 2020-110774

(51) Int. Cl.
*F25B 9/14* (2006.01)
*F25B 41/20* (2021.01)

(52) U.S. Cl.
CPC ..... *F25B 9/145* (2013.01); *F25B 41/20* (2021.01); *F25B 2309/1403* (2013.01); *F25B 2309/1418* (2013.01); *F25B 2313/001* (2013.01)

(58) Field of Classification Search
CPC ..... F25B 9/145; F25B 2309/1403; F25B 2309/1418; F25B 2309/1405; F25B 2309/1413; F25B 2313/001; F02G 2243/54
See application file for complete search history.

(56) References Cited

U.S. PATENT DOCUMENTS 8,584,471 B2 * 11/2013 Schwartz ..... F25B 9/145 62/79
2007/0221367 A1 * 9/2007 Watanabe ..... B60H 1/00 165/172
2013/0298547 A1 11/2013 Yamamoto et al.

FOREIGN PATENT DOCUMENTS

JP 3050543 B1 6/2000
JP 2005-188841 A 7/2005
JP 2007-263500 A 10/2007
JP 4443971 B2 3/2010
JP 2013-234822 A 11/2013

* cited by examiner

*Primary Examiner* — Lionel Nouketcha
(74) *Attorney, Agent, or Firm* — Harness, Dickey & Pierce, P.L.C.

(57) ABSTRACT

Provided is a thermoacoustic refrigerator including an air column pipe, a prime mover, a load, and a heat accumulation tank. An exhaust gas supplied to and discharged from the heat accumulation tank is supplied, as a heat source, to the prime mover disposed inside the air column pipe, so as to cause self-oscillation of a working gas filled in the air column pipe so that sound waves are generated. With the sound waves, the load disposed inside the air column pipe converts sound wave energy into heat energy, so as to output cold heat.

7 Claims, 9 Drawing Sheets

THERMOACOUSTIC REFRIGERATOR

This Nonprovisional application claims priority under 35 U.S.C. § 119 on Patent Application No. 2020-110774 filed in Japan on Jun. 26, 2020, the entire contents of which are hereby incorporated by reference.

TECHNICAL FIELD

The present invention relates to a thermoacoustic refrigerator that utilizes a thermoacoustic phenomenon.

BACKGROUND ART

Heretofore, there has been proposed cooling/refrigeration equipment utilizing a thermoacoustic phenomenon (see Patent Literature 1, for example). The conventional thermoacoustic refrigerator includes a prime mover, a load, and piping, and utilizes sunlight as a heat source. Patent Literature 1 discloses, as an application example, a cooler box for automobiles that uses an exhaust gas of an automobile as a heat source.

CITATION LIST

Patent Literature

[Patent Literature 1]
Japanese Patent No. 3050543

SUMMARY OF INVENTION

Technical Problem

Unfortunately, since the conventional technique disclosed in Patent Literature 1 uses a supply source of a waste heat (e.g., an exhaust gas) as the heat source, an amount of heat supplied to the prime mover changes when an output from the heat source changes. As a result, a cold heat output from the load also changes, and consequently the thermoacoustic refrigerator cannot operate stably, disadvantageously.

The present invention was made in view of the problem described above. An object of an aspect of the present invention is to provide a thermoacoustic refrigerator that stabilize a cold heat output from a load and thus can operate stably even when an output from a supply source of a waste heat (e.g., sunlight or an exhaust gas) changes.

Solution to Problem

In order to attain the object, a thermoacoustic refrigerator in accordance with an aspect of the present invention includes: an air column pipe filled with a working gas; a prime mover disposed inside the air column pipe and configured to generate sound waves; a load disposed inside the air column pipe and configured to output cold heat; and at least one heat accumulation tank having an internal space provided with a heat accumulation body, said at least one heat accumulation tank being connectable to the prime mover, the prime mover being connected to said at least one heat accumulation tank, said at least one heat accumulation tank receiving a first heating medium supplied thereto, said at least one heat accumulation tank discharging and supplying, to the prime mover, the first heating medium having undergone heat exchange so that self-oscillation of the working gas is caused and sound waves are generated in the prime mover, the load being operated by the sound waves thus generated.

In order to attain the object, a thermoacoustic refrigerator in accordance with another aspect of the present invention includes: an air column pipe filled with a working gas; a prime mover disposed inside the air column pipe and configured to generate sound waves; a load disposed inside the air column pipe and configured to output cold heat; and at least one heat accumulation tank having an internal space provided with a heat accumulation body, said at least one heat accumulation tank being connectable to the prime mover, the prime mover being connected to said at least one heat accumulation tank having received a first heating medium supplied thereto and having accumulated heat therein, said at least one heat accumulation tank having accumulated the heat therein receiving a second heating medium supplied thereto at a given airflow rate, said at least one heat accumulation tank supplying, to the prime mover, the second heating medium heated as a result of heat exchange so that self-oscillation of the working gas is caused and sound waves are generated in the prime mover, the load being operated by the sound waves thus generated.

Advantageous Effects of Invention

According to an aspect of the present invention, it is possible to provide a thermoacoustic refrigerator that can stabilize a cold heat output from a load and thus can operate stably even when an output from a supply source of a waste heat (e.g., sunlight or an exhaust gas) changes.

DESCRIPTION OF EMBODIMENTS

The following will provide a detailed description of embodiments of the present invention, with reference to the drawings. Note that the present invention is not limited to the following embodiments in any way.

Embodiment 1

Figure 1:
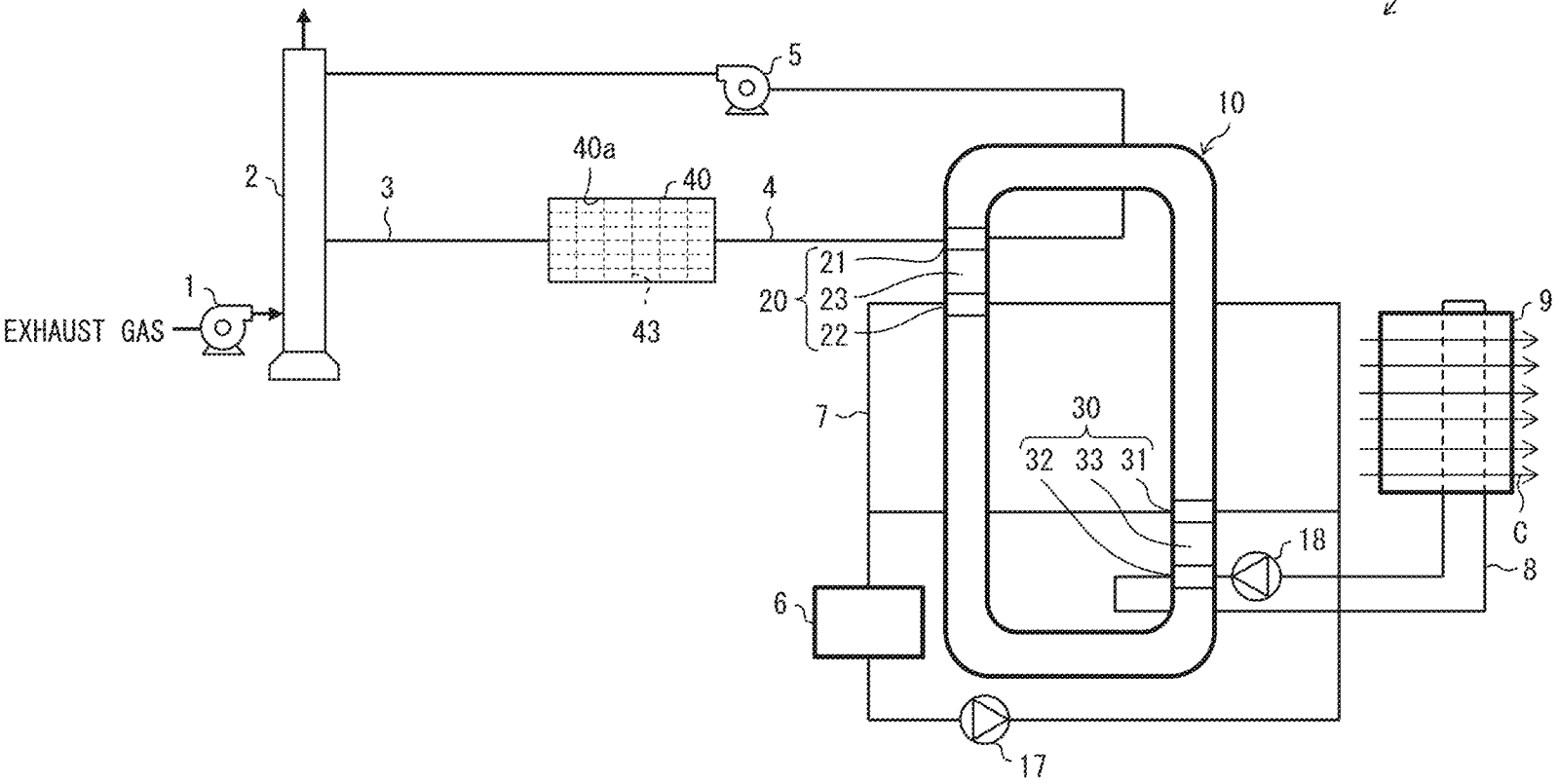
FIG. 1 is a view schematically illustrating a configuration of a thermoacoustic refrigerator in accordance with Embodiment 1.

The following will provide a detailed description of Embodiment 1 of the present invention. A thermoacoustic refrigerator 100 in accordance with Embodiment 1 utilizes waste heat of a heating medium. The heating medium used in Embodiment 1 is one kind of heating medium, specifically, a first heating medium. For example, the thermoacoustic refrigerator 100 utilizes, as the first heating medium, an exhaust gas discharged from a duct 2. The thermoacoustic refrigerator 100 can be used as a cooler for cooling equipment or refrigeration equipment, for example. As illustrated in FIG. 1, the thermoacoustic refrigerator 100 includes supply piping 3, exhaust piping 4, an air column pipe 10, a prime mover 20, a load 30, and a heat accumulation tank 40. Note that, through the duct 2, an exhaust gas introduced via a first-heating-medium blower 1 flows.

The air column pipe 10 is a loop pipe made of metal. In the configuration shown in FIG. 1, the air column pipe 10 is a noncircular loop pipe, and is filled with helium and/or the like as a working gas. The prime mover 20 and the load 30 are disposed inside the air column pipe 10. Note that the material of the air column pipe 10 is not limited to metal, and may be of any kind, provided that it has a sufficient strength under a pressure of the working gas and under an operating temperature condition.

The prime mover 20 includes a prime-mover-side high-temperature heat exchanger 21, a prime-mover-side low-temperature heat exchanger 22, and a heat accumulator 23. The prime-mover-side high-temperature heat exchanger 21 is disposed at a first end of the heat accumulator 23, and the prime-mover-side low-temperature heat exchanger 22 is disposed at a second end of the heat accumulator 23. The prime mover 20 functions as a sound wave generator.

The load 30 includes a load-side high-temperature heat exchanger 31, a load-side low-temperature heat exchanger 32, and a cold accumulator 33. The load-side high-temperature heat exchanger 31 is disposed at a first end of the cold accumulator 33. The load-side low-temperature heat exchanger 32 is disposed at a second end of the cold accumulator 33. The load 30 functions as a regenerative heat exchanger.

The heat accumulation tank 40 is made of a container, a metal housing, or a metal can body each of which is detachably connectable to the supply piping 3 and the exhaust piping 4, for example. Thus, the heat accumulation tank 40 is detachably connectable to the pieces of piping. Particularly, in Embodiment 1, the prime-mover-side high-temperature heat exchanger 21 is connected to an intermediate part of the exhaust piping 4. Thus, the heat accumulation tank 40 is detachably connectable to the prime mover 20 via the exhaust piping 4 connected to the prime-mover-side high-temperature heat exchanger 21. In addition, the outer or inner surface of the heat accumulation tank 40 is covered with a heat insulator. The heat accumulation tank 40 is disposed at a location between the duct 2 and the prime mover 20. Note that the heat accumulation tank 40 is not necessarily detachably connectable to the prime mover 20, provided that the heat accumulation tank 40 can be connected to the prime mover 20.

In addition, the heat accumulation tank 40 has an internal space 40*a* provided with a heat accumulation body 43. More specifically, the heat accumulation tank 40 has a plurality of heat accumulation bodies 43 filled in the internal space 40*a* of the heat accumulation tank 40. In the heat accumulation tank 40, heat exchange takes place between an exhaust gas and the heat accumulation bodies 43 while the exhaust gas, which is the first heating medium, is flowing through the internal space 40*a*.

The heat accumulation bodies 43 may be an air-permeable porous object made of metal or ceramics or a laminate of plural air-permeable porous objects. The heat accumulation bodies 43 are preferably made of a material having a high heat capacity and a high heat conductivity. Furthermore, the heat accumulation bodies 43 preferably have a shape that allows the heating medium to pass therethrough with a small resistance and that has a large heat transfer area. Specifically, the heat accumulation bodies 43 may be a ceramic honeycomb, a metal mesh, or a stone, for example. The heat accumulation tank 40 may be the one including any of them filled in its internal space 40*a* and being structured to provide plural channels.

The heat accumulation tank 40 has a first side detachably connected to the supply piping 3 connected to the duct 2. The heat accumulation tank 40 has a second side detachably connected to the exhaust piping 4.

The exhaust gas is supplied to the internal space 40*a* from the duct 2 via the supply piping 3, and then passes through the heat accumulation tank 40. Then, the exhaust gas carries out heat exchange with the heat accumulation bodies 43 filled in the internal space 40*a*, and then flows to the exhaust piping 4.

Even when the temperature of the exhaust gas flowing through the duct 2 changes, heat exchange takes place between the exhaust gas and the heat accumulation bodies 43, thanks to an adequately large heat capacity of the heat accumulation bodies 43. This can reduce the extent of temporal changes in the temperature of the exhaust gas discharged from the heat accumulation tank 40.

The exhaust gas flowing through the exhaust piping 4 carries out heat exchange in the prime-mover-side high-temperature heat exchanger 21, and is then returned to the duct 2 via an exhaust blower 5. The prime-mover-side low-temperature heat exchanger 22 and the load-side high-temperature heat exchanger 31 are connected to circulation piping 7. Although the exhaust gas is returned to the duct 2 in the example shown in FIG. 1, the exhaust gas does not necessarily need to be returned to the duct 2. Alternatively, for example, the exhaust gas may be discharged to the atmosphere as it is.

The circulation piping 7 is provided with a cooler 6 for cooling circulating water and a circulation pump 17. The circulating water circulates through the circulation piping 7.

The example shown in FIG. 1 employs the circulating water. In place of the circulating water, a refrigerant such as glycol may be used. The example shown in FIG. 1 employs the cooler 6 for cooling the circulating water so that the circulating water can be used by circulation. However, the cooler 6 may be omitted, and tap water or well water of a given temperature may be used without circulation.

In addition, in the example shown in FIG. 1, the circulating water is supplied in parallel to the prime mover 20 and the load 30. Alternatively, the circulating water may be supplied in series to the prime mover 20 and the load 30.

When the exhaust gas is supplied to the prime-mover-side high-temperature heat exchanger 21 and the circulating water is supplied to the prime-mover-side low-temperature heat exchanger 22, a given temperature difference occurs between the first and second sides of the heat accumulator 23, which causes self-oscillation of the working gas. Meanwhile, the load-side low-temperature heat exchanger 32 is connected to cooling piping 8, and the cooling piping 8 is provided with a pump 18.

Through the cooling piping 8, a refrigerant (e.g., an antifreezing solution) used for cooling flows. When the circulating water and the refrigerant are respectively supplied to the load-side high-temperature heat exchanger 31 and the load-side low-temperature heat exchanger 32 and sound waves generated in the prime mover 20 are propagated to the load 30, sound wave energy is converted into heat energy, and consequently a temperature difference occurs between the first and second ends of the cold accumulator 33, which leads to a reduction in the temperature of the refrigerant.

The cooling piping 8 is provided with a radiator 9. The refrigerant discharged from the load-side low-temperature heat exchanger 32 is used for cooling operation through the radiator 9.

In the example shown in FIG. 1, the refrigerant is used for cooling operation by circulating the refrigerant between the load-side low-temperature heat exchanger 32 and the radiator 9. In place of the refrigerant, water may be used. In this case, it is possible to obtain a coolant directly.

In Embodiment 1, the heat accumulation tank 40 is disposed at a location between the duct 2 and the prime mover 20, and the first side of the heat accumulation tank 40 is connected to the supply piping 3, as described above. Furthermore, the second side of the heat accumulation tank 40 is connected to the exhaust piping 4, and the exhaust gas discharged from the heat accumulation tank 40 is directly supplied to the prime mover 20 so as to be used as a heat source. In this manner, by using, as the heat source, the exhaust gas made less apt to change its temperature in the heat accumulation tank 40, self-oscillation of the working gas is caused by the prime mover 20 in order to generate sound waves. By the sound waves, the load 30 is operated.

With the thermoacoustic refrigerator 100 described above, it is possible to use, as the heating medium for heating the prime-mover-side high-temperature heat exchanger 21, a stable and high-temperature exhaust gas discharged from the heat accumulation tank 40. In other words, in accordance with the thermoacoustic refrigerator 100, even when the temperature of the exhaust gas changes, it is possible to stabilize the temperature of the exhaust gas discharged from the heat accumulation tank 40, thanks to a large heat accumulation amount and a large heat capacity of the heat accumulation bodies 43 filled in the heat accumulation tank 40. This leads to little changes in the output of the heat source to the prime mover 20, thereby stabilizing a cold heat output. Consequently, the thermoacoustic refrigerator 100 can operate stably.

Embodiment 2

Figure 2:
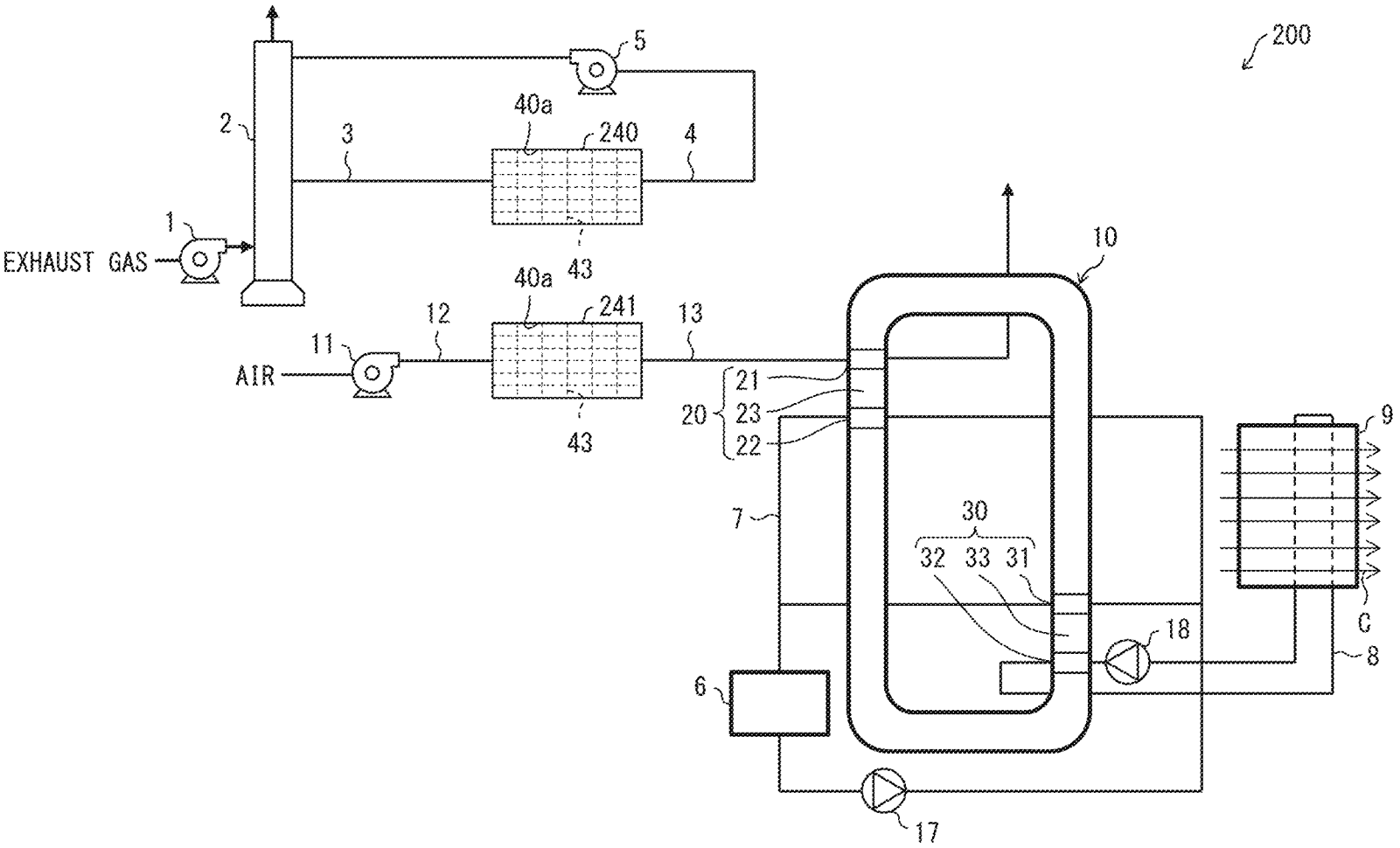
FIG. 2 is a view schematically illustrating a configuration of a thermoacoustic refrigerator in accordance with Embodiment 2.
Figure 3:
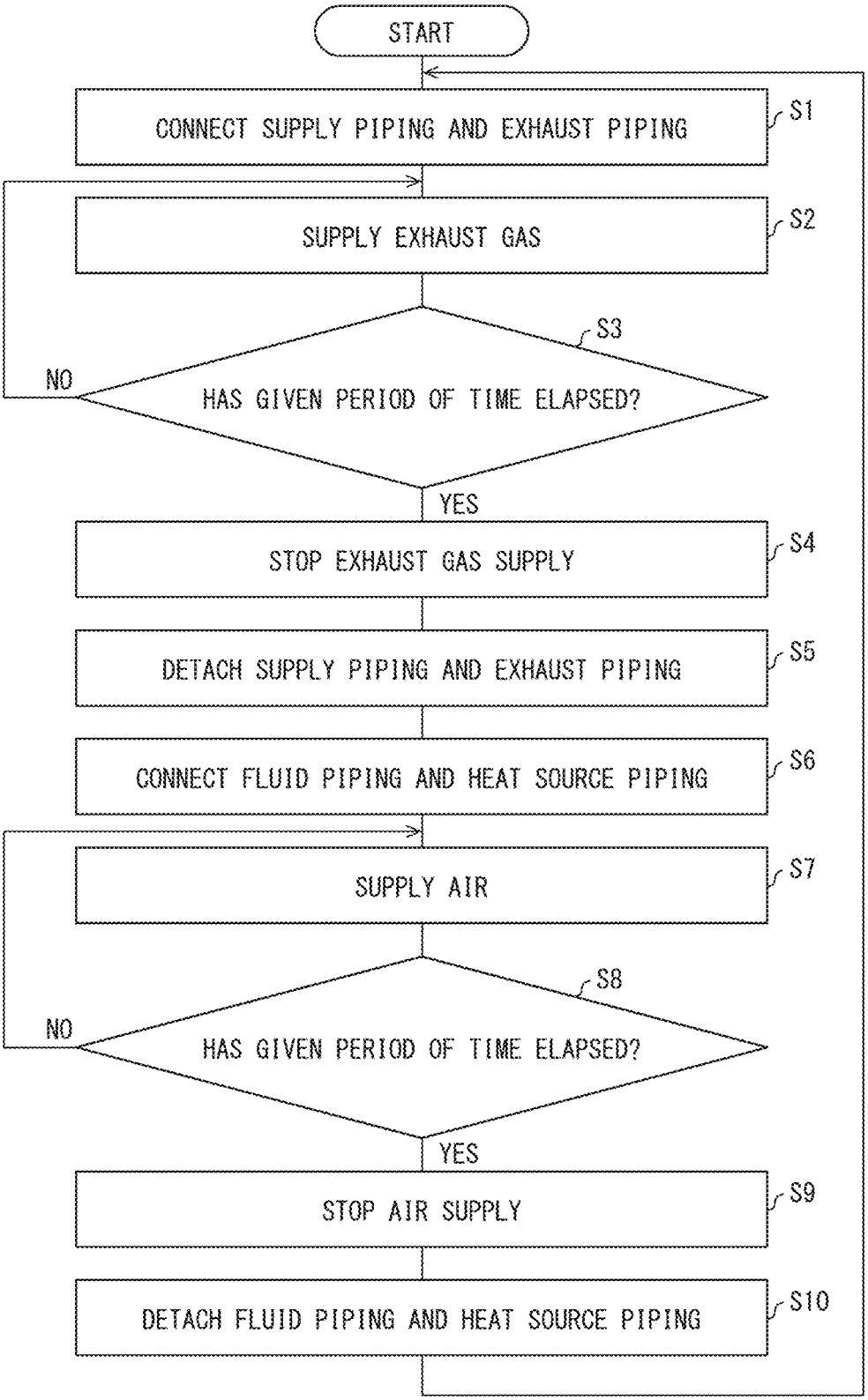
FIG. 3 is a flowchart illustrating a method of how to use the thermoacoustic refrigerator in accordance with Embodiment 2.

The following will describe Embodiment 2 of the present invention with reference to FIGS. 2 and 3. For convenience of description, members having functions identical to those described in Embodiment 1 are assigned identical referential numerals, and their descriptions are omitted here.

As illustrated in FIG. 2, a thermoacoustic refrigerator 200 in accordance with Embodiment 2 further includes a second-heating-medium blower 11, fluid piping 12, heat source piping 13, and a plurality of heat accumulation tanks. In the example shown in FIG. 2, the plurality of heat accumulation tanks are two heat accumulation tanks, specifically, a first heat accumulation tank 240 and a second heat accumulation tank 241. The first heat accumulation tank 240 and the second heat accumulation tank 241 are used as the heat source successively in order. Note that, in the example shown in FIG. 2, the expression "first" of the first heat accumulation tank 240 and the expression "second" of the second heat accumulation tank 241 are used only for convenience of explanation. Thus, for example, replacing the expressions "first" and "second" does not change the nature of the present invention. This applies also to the later-described Embodiments.

Embodiment 2 uses, as the heating medium, two kinds of heating media, specifically, a first heating medium and a second heating medium. On this point, Embodiment 1 differs from Embodiment 1.

The second-heating-medium blower 11 is a blower for supplying the second heating medium to the heat accumulation tank at a given airflow rate. In Embodiment 2, the second-heating-medium blower 11 is disposed so as to precede the second heat accumulation tank 241. For example, the second-heating-medium blower 11 is connected to the fluid piping 12. The fluid piping 12 is detachably connected to the second heat accumulation tank 241. The second heat accumulation tank 241 has a first side detachably connected to the second-heating-medium blower 11 via the fluid piping 12. The second heat accumulation tank 241 has a second side detachably connected to the heat source piping 13, and is connected to the prime-mover-side high-temperature heat exchanger 21 via the heat source piping 13. That is, the second heat accumulation tank 241 is detachably connected to the prime mover 20 via the heat source piping 13. In Embodiment 2, air is used as the second heating medium, and is supplied to the second heat accumulation tank 241 via the fluid piping 12 by the second-heating-medium blower 11. The first heating medium is the same as that in Embodiment 1.

The first heat accumulation tank 240 and the second heat accumulation tank 241 each have an internal space **40*a* provided with heat accumulation bodies 43. The heat accumulation tanks 240 and 241 are detachably connectable to the supply piping 3 and the exhaust piping 4. The heat accumulation tanks 240 and 241 are each made of a container, a metal housing, or a metal can body. On this point, the heat accumulation tanks 240 and 241 are the same as the heat accumulation tank 40 of Embodiment 1. Furthermore, the heat accumulation tanks 240 and 241 are detachably connectable to the fluid piping 12 and the heat source piping 13. A connection between a first side of the first heat accumulation tank 240 and the supply piping 3 is made in a similar manner to that in Embodiment 1. However, a connection between a second side of the first heat accumulation tank 240 and the exhaust piping 4 is made in a different manner from that in Embodiment 1. Specifically, the exhaust piping 4 and the prime-mover-side high-temperature heat exchanger 21 are not connected to each other, and thus the exhaust gas is returned to the duct 2 via the exhaust blower 5, without passing through the prime mover 20**.

Note that, in a case where the first heat accumulation tank 240 and the second heat accumulation tank 241 are each made of a container, a metal housing, or a metal can body detachably connectable to the pieces of piping, it is possible to transport the heat accumulation tank in which heat is accumulated, by detaching the supply piping 3 and the exhaust piping 4 therefrom. In addition, since each of the heat accumulation tanks is detachably connectable to the pieces of piping and to the prime mover 20, a heat accumulation process and a successive operation process (each will be described later) can be carried out with a single heat accumulation tank.

In the example shown in FIG. 2, the second heat accumulation tank 241 is disposed at a location between the second-heating-medium blower 11 and the prime mover 20. In Embodiment 2, the second-heating-medium blower 11 is disposed so as to precede the heat accumulation tank. However, the second-heating-medium blower 11 does not necessarily need to be disposed to precede the second heat accumulation tank 241.

Next, the following will provide a detailed description of a method of how to use the thermoacoustic refrigerator 200, with reference to FIGS. 2 and 3.

(Heat Accumulation Process)

First, a user carries out the heat accumulation process in the manner as illustrated in FIG. 3. As step S1, the user connects the supply piping 3 and the exhaust piping 4 to the first heat accumulation tank 240 as illustrated in FIG. 2, for example. Next, as step S2, the user supplies an exhaust gas to the first heat accumulation tank 240 with the exhaust blower 5. Then, as step S3, the user waits for a lapse of a given period of time. The given period of time in the heat accumulation process is a period of time taken until the temperature of the exhaust gas discharged from the first heat accumulation tank 240 reaches a given temperature. In step S3, if the given period of time has not elapsed, the user returns to step S2 to keep supplying the exhaust gas and continue the heat accumulation process.

At a timing immediately after the start of the supply of the exhaust gas to the first heat accumulation tank 240, the heat accumulation bodies 43 are cooled sufficiently (e.g., at normal temperature), and therefore a temperature difference between the exhaust gas and the heat accumulation bodies 43 is the largest. Thus, the temperature of the exhaust gas undergone heat exchange with the heat accumulation bodies 43 and discharged from the first heat accumulation tank 240 is the lowest. When the heat accumulation bodies 43 are heated and the heat is accumulated therein adequately along with the lapse of time, the temperature difference between the exhaust gas and the heat accumulation bodies 43 becomes smaller. Consequently, the amount of heat exchanged between the exhaust gas and the heat accumulation bodies 43 also becomes smaller. As a result, the temperature of the exhaust gas discharged from the first heat accumulation tank 240 gets closer to the temperature of the exhaust gas flowing through the supply piping 3.

In the example shown in FIG. 3, at a timing when a period of time preliminarily estimated to be taken until the temperature of the exhaust gas reaches the given temperature, e.g., 12 hours, has elapsed, the user goes to step S4. In step S4, the user stops the exhaust blower 5 to stop the supply of the exhaust gas. Subsequently, in step S5, the user detaches the supply piping 3 and the exhaust piping 4 from the first heat accumulation tank 240, so that the heat accumulation process for the first heat accumulation tank 240 ends. When the heat accumulation process ends, the user goes to the successive operation process, which is carried out in step S6 and its subsequent steps.

Note that the user may not proceed to the successive operation process immediately after the heat accumulation process, but may transport the heat accumulation tank in which the heat is accumulated. Instead of the determination in step S3 as to whether the given period of time has elapsed, the following may be carried out. That is, for example, thermometers are respectively provided to the supply piping 3 and the exhaust piping 4. Then, at a timing when temperatures measured by the two thermometers or a difference between the temperatures measured by the two thermometers reach(s) a given value(s), the user may proceed to step S4 to end the heat accumulation process.

(Successive Operation Process)

Next, the user carries out the successive operation process. As step S6, for example, the user connects the fluid piping 12 and the heat source piping 13 to the first and second sides of the first heat accumulation tank 240, respectively. Next, as step S7, the user supplies air to the first heat accumulation tank 240 with the second-heating-medium blower 11. Consequently, the air is supplied, at a given airflow rate, to the first heat accumulation tank 240 in which the heat is accumulated due to the exhaust gas supplied thereto in the heat accumulation process. Then, as step S8, the user waits for a lapse of the given period of time. In step S8, if the given period of time has not elapsed, the user returns to step S7 to keep supplying the air.

Thus, the air having been heated as a result of heat exchange with the heat accumulation bodies 43 in the first heat accumulation tank 240 is supplied to the prime mover 20, and is used as the heat source. In the thermoacoustic refrigerator 200, self-oscillation of the working gas is caused by the prime mover 20 so that sound waves are generated. The load 30 is operated by the sound waves.

In the example shown in FIG. 3, at a timing when a period of time preliminarily estimated to be taken until the temperature of the exhaust gas reaches the given temperature, e.g., 12 hours, has elapsed, the user goes to step S9. In step S9, the user stops the second-heating-medium blower 11 to stop the supply of the air. Step 9 is a step of stopping the air supply to the first heat accumulation tank 240 in order to deal with a phenomenon that, when the given period of time has elapsed, the temperature of the air discharged from the first heat accumulation tank 240 drops below a minimum temperature required to cause self-oscillation of the working gas in the prime mover 20. Next, in step S10, the user detaches the fluid piping 12 and the heat source piping 13 from the first heat accumulation tank 240, so that the successive operation process ends.

Note that, in step S9, the air supply may not be stopped simply when the given period of time has elapsed. Alternatively, the following may be carried out in step S9. That is, for example, a thermometer may be provided to the heat source piping 13. Then, at a timing when the temperature measured by the thermometer drops to a given value, the air supply to the first heat accumulation tank 240 may be stopped. The given value may be the value of a minimum temperature required to cause self-oscillation of the working gas in the prime mover 20, for example.

Thereafter, the user returns to step S1 to accumulate heat in the first heat accumulation tank 240. Note that, while the first heat accumulation tank 240 is used as the heat source of the prime mover 20, it is possible to connect the supply piping 3 and the exhaust piping 4 to the first and second sides of the second heat accumulation tank 241, respectively, to carry out the heat accumulation process. In this manner, the first heat accumulation tank 240 and the second heat accumulation tank 241 can be used as the heat source successively in order.

With the thermoacoustic refrigerator 200, even if the airflow rate of the exhaust gas changes or even becomes zero, it is possible to stably supply the heat source to the prime-mover-side high-temperature heat exchanger 21 in the following manner. Specifically, it is possible to stably supply, to the prime-mover-side high-temperature heat exchanger 21, a given amount of the air having been heated as a result of heat exchange taken place in the first heat accumulation tank 240 or the second heat accumulation tank 241 via the second-heating-medium blower 11. Therefore, in accordance with the thermoacoustic refrigerator 200, while a given amount or more of heat is held in the heat accumulation tank that is used as the heat source, the output of the high-temperature air changes little, and therefore a cold heat output is stabilized, whereby the thermoacoustic refrigerator 200 can operate stably.

Here, the expression "while a given amount or more of heat is held" means a period until the temperature measured by the thermometer provided to the heat source piping 13 drops to the minimum temperature required to cause self-oscillation of the working gas in the prime mover 20, for example.

Embodiment 3

Figure 4:
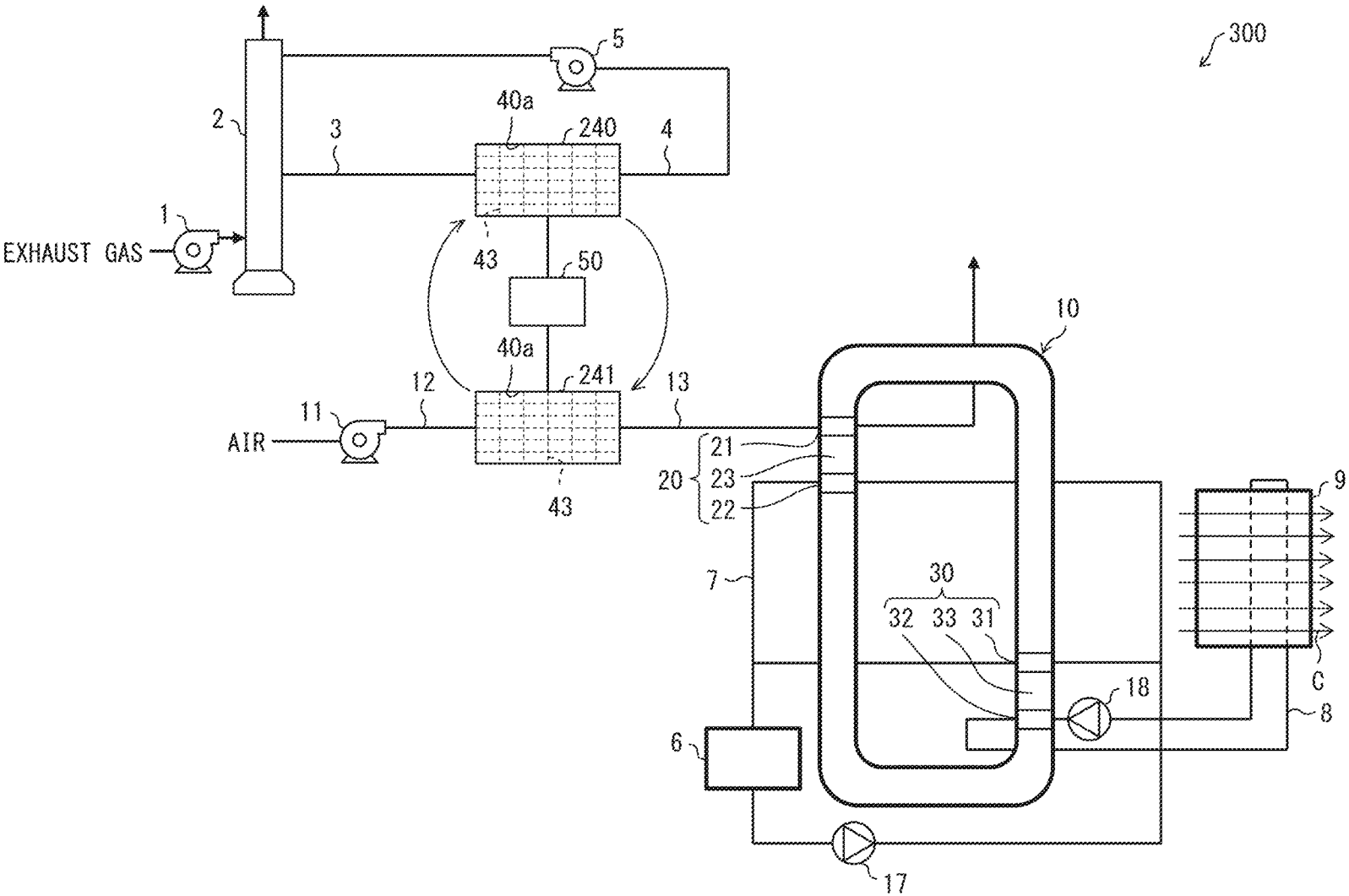
FIG. 4 is a view schematically illustrating a configuration of a thermoacoustic refrigerator in accordance with Embodiment 3.

As illustrated in FIG. 4, the thermoacoustic refrigerator 300 in accordance with Embodiment 3 further includes a switching mechanism 50. Note that parts corresponding to those in FIG. 2 are indicated by the same reference signs, and explanations thereof are omitted as appropriate.

The switching mechanism 50 makes it possible to carry out switching between a plurality of heat accumulation tanks so that a heat accumulation tank to which an exhaust gas is supplied and a heat accumulation tank to which air is supplied are switched to each other. Examples of a switching method employed by the switching mechanism 50 encompass a tank-rotation method that turns the heat accumulation tanks, a rotary-valve method that carries out switching with use of a rotary valve without turning the tanks, and a switching-valve method that carries out switching with use of a switching valve. The timing of the switching carried out by the switching mechanism 50 may be determined by, for example, a period of time lapsed after switching or a measured temperature value obtained by a temperature sensor provided to measure a temperature of a heating medium. Alternatively, the switching may be carried out by turning the heat accumulation tanks or the rotary valve at a certain cycle, for example.

In a case where switching between the plurality of heat accumulation tanks is carried out by the switching mechanism 50, a measured temperature value of high-temperature air, heat transfer oil, or heating medium of another kind measured at or near the inlet of the prime-mover-side high-temperature heat exchanger 21 is the most important. The reason for this is as below. That is, when the temperature of the heating medium at or near the inlet of the prime-mover-side high-temperature heat exchanger 21 is lower than a given temperature, a temperature difference between the prime-mover-side high-temperature heat exchanger 21 and the prime-mover-side low-temperature heat exchanger 22 is below an allowable value. Accordingly, the amount of sound waves generated in the heat accumulator 23 becomes small, and consequently a desired cold heat output cannot be obtained from the cold accumulator 33. Therefore, it is preferable to measure a temperature at least at or near the outlet of the heat accumulation tank to which the air is supplied. More preferably, the switching mechanism 50 carries out the switching according to the temperature of the air in the fluid piping 12 and the temperature of the air in the heat source piping 13 or a temperature difference between the temperature of the air in the fluid piping 12 and the temperature of the air in the heat source piping 13, for example.

With the thermoacoustic refrigerator 300, it is possible to carry out the switching in an easy and simple manner, even when the frequency of the switching is increased.

Embodiment 4

A thermoacoustic refrigerator in accordance with Embodiment 4 employs, as one example of the switching mechanism of Embodiment 3, a switching mechanism 450 employing the tank-rotation method. Embodiment 4 includes heat accumulation tanks each having an internal space 40*a* provided with heat accumulation bodies 43. On this point, Embodiment 4 is the same as Embodiments 1 to 3.

Figure 5:
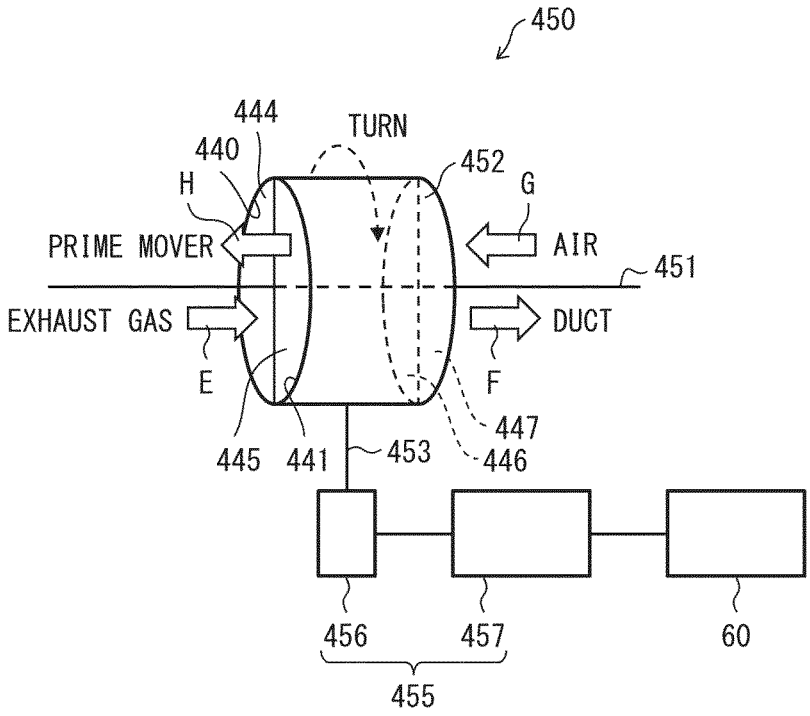
FIG. 5 is an explanatory view illustrating one example of a combination of a switching mechanism and a plurality of heat accumulation tanks.

As illustrated in FIG. 5, a switching mechanism 450 includes a turning part 452, a driving part 455, a chain 453, and a control part 60.

The turning part 452 has a substantially circular cylindrical shape having a hollow part, and has an outer surface to which the chain 453 is engageable in such a manner that the turning part 452 is turnable. In addition, the turning part 452 is structured to be capable of storing plural heat accumulation tanks in its hollow part. Furthermore, the turning part 452 has, in its center, a shaft part 451 serving as a turning shaft, and is turnable around the shaft part 451 that serves as a center shaft.

The driving part 455 includes a sprocket 456 and a motor 457, and causes the turning part 452 to turn via the chain 453. The sprocket 456 is provided at a rotational shaft of the motor 457.

The chain 453 is wound around the outer surface of the turning part 452 and the sprocket 456. When the motor 457 is driven and rotated by the control part 60, the turning part 452 is caused to turn via the sprocket 456.

In the example shown in FIG. 5, the chain 453 is provided so as to be engaged to the outer surface of the turning part 452 of the chain 453. Alternatively, the chain 453 may be provided so as to be engaged to the shaft part 451. Further alternatively, the motor 457 and the shaft part 451 may be directly connected with each other, not via the chain 453.

The turning part 452 includes, in its hollow part, a first heat accumulation tank 440 and a second heat accumulation tank 441. The first heat accumulation tank 440 and the second heat accumulation tank 441 are integrated with the turning part 452.

The first heat accumulation tank 440 has a shape corresponding to a semicircular column in the hollow part of the turning part 452. The first heat accumulation tank 440 has, on its first side, a first opening 444 having an area corresponding to the area of the semicircle, and has a third opening 446 on its second side. The first opening 444 and the third opening 446 are identical to each other in opening area.

Figure 6:
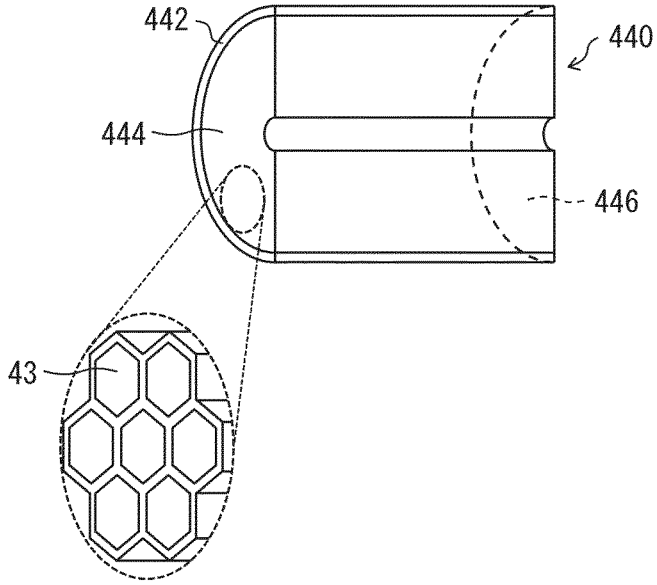
FIG. 6 is a perspective view of a first heat accumulation tank in accordance with Embodiment 4, including a partial enlarged view.

More specifically, the first heat accumulation tank 440 has a plurality of heat accumulation bodies 43 surrounded by a tank wall 442, which forms a semicircular column, as illustrated in FIG. 6. The first opening 444 has a plurality of hexagonal holes constituting a honeycomb end surface of the heat accumulation bodies 43. Note that the heat accumulation bodies 43 are not limited to the ones constituting hexagonal holes. Alternatively, the heat accumulation bodies 43 may be the ones constituting a honeycomb and having triangular or quadrangular holes partitioned by partition walls. The heat accumulation bodies 43 may not be a honeycomb, and may be a filler such as a stone.

The second heat accumulation tank 441 has a shape corresponding to another semicircular column in the hollow part of the turning part 452. The second heat accumulation tank 441 has, on its first side, a second opening 445 having an area corresponding to the area of the semicircle, and has a fourth opening 447 on its second side. The second opening 445 and the fourth opening 447 are identical to each other in opening area. The second heat accumulation tank 441 has a plurality of heat accumulation bodies surrounded by a tank wall, which forms a semicircular column. On this point, the second heat accumulation tank 441 is the same as the first heat accumulation tank 440.

For the first heat accumulation tank 440 and the second heat accumulation tank 441, a ratio between the opening areas of the first opening 444 the second opening 445 is set in accordance with a ratio between the airflow rates of the exhaust gas and the air. In the examples shown in FIGS. 5 and 6, two heat accumulation tanks (440, 441) are combined to each other to constitute the single circular cylindrical turning part 452. However, this is not limitative. Alternatively, for example, a variation illustrated in FIGS. 7 and 8 may be adopted.

Figure 7:
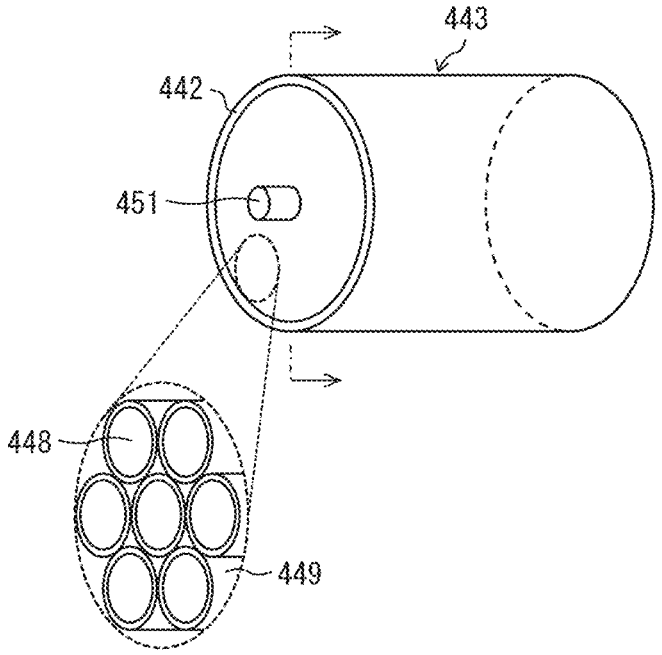
FIG. 7 is a perspective view of a variation of the heat accumulation tank in accordance with Embodiment 4.
Figure 8:
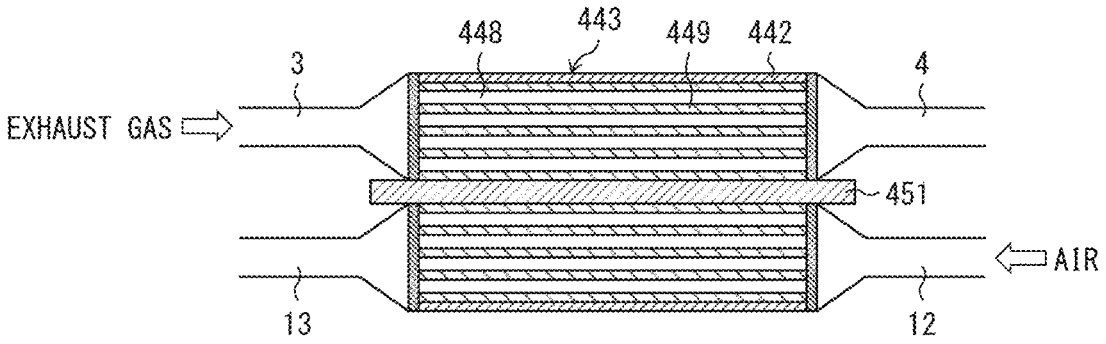
FIG. 8 is a cross-sectional view illustrating connections between the heat accumulation tank in accordance with the variation of Embodiment 4 and pieces of piping.

A heat accumulation tank 443 in accordance with the variation includes heat accumulation bodies being made of a material or being formed in a finely-divided shape, each of the maternal and the finely-divided shape allowing an exhaust gas and air to flow in a direction parallel with the shaft part 451 and not allowing the exhaust gas and air to be diffused in a circumferential direction perpendicular to the shaft part 451. Examples thereof encompass a honeycomb ceramic. For example, as illustrated in FIG. 7, the heat accumulation tank 443 has a plurality of through-holes 448 penetrating through two openings of a first heat accumulation tank 440 and partition walls 449 partitioning the through-holes 448 from each other. In this case, as illustrated in FIG. 8, supply piping 3 for exhaust gas supply and heat source piping 13 for air discharge are arranged so as to be in contact with one of two end surfaces of the single circular cylindrical heat accumulation tank 443, whereas exhaust piping 4 for exhaust gas discharge and fluid piping 12 for air supply are arranged so as to be in contact with the other of the two end surfaces. Packings are disposed between the heat accumulation tank 443 and the four pieces of piping (3, 4, 12, 13). The end surfaces of the heat accumulation tank 443 have an area similar to the area of the four openings (444 to 447) of Embodiment 4.

Through the end surface that is in contact with the supply piping 3 and the heat source piping 13, the exhaust gas and the air flow in the following manner. That is, the exhaust gas is supplied from the supply piping 3 to ones of through-holes 448 facing the outlet of the supply piping 3. The air is discharged, to the heat source piping 13, from ones of the through-holes 448 facing the inlet of the heat source piping 13. Meanwhile, through the end surface that is in contact with the exhaust piping 4 and the fluid piping 12, the exhaust gas and the air flow in the following manner. That is, the air is supplied from the fluid piping 12 to ones of the through-holes 448 facing the outlet of the fluid piping 12. The exhaust gas is discharged, to the exhaust piping 4 from ones of the through-holes 448 facing the inlet of the exhaust piping 4.

That is, the exhaust gas passes through the ones of the through-holes 448 facing the outlet of the supply piping 3 and the inlet of the exhaust piping 4, whereas the air passes through the ones of the through-holes 448 facing the outlet of the fluid piping 12 and the inlet of the heat source piping 13.

According to the variation, the supply piping 3 for exhaust gas supply and the heat source piping 13 for air discharge are arranged so as to be in contact with one of the two end surfaces of the single circular cylindrical heat accumulation tank, whereas the exhaust piping 4 for exhaust gas discharge and the fluid piping 12 for air supply are arranged so as to be in contact with the other of the two end surfaces. According to this arrangement, the single heat accumulation tank 443 can function as two heat accumulation tanks, since the heat accumulation tank 443 can prevent a phenomenon that the air and the exhaust gas flowing therein pass through a space near the partition walls 449 surrounding the through-holes 448 serving as the heat accumulation bodies and are mixed with each other.

That is, the thermoacoustic refrigerator in accordance with the variation of Embodiment 4 may include heat accumulation bodies being made of a material or being formed in a finely-divided shape, each of the material and the finely-divided shape allowing the exhaust gas and air to flow in a direction parallel with the shaft part 451 and not allowing the exhaust gas and air to be diffused in a circumferential direction perpendicular to the shaft part 451.

In addition to this configuration, the thermoacoustic refrigerator in accordance with the variation of Embodiment 4 is configured such that the heat accumulation tank is formed into a substantially circular cylindrical turnable member having an internal space provided with heat accumulation bodies. Furthermore, the thermoacoustic refrigerator in accordance with the variation of Embodiment 4 may be provided with a turning mechanism configured to turn the heat accumulation tank that is a substantially circular cylindrical turnable member. In this case, the turning mechanism may include a driving part 455 and a chain 453. In this case, the turning mechanism may be structured such that the chain 453 is turnably engaged to the outer surface of the substantially circular cylindrical turnable member. Alternatively, the turning mechanism may be structured such that the chain 453 is turnably engaged to the shaft part 451. Further alternatively, the turning mechanism may be achieved by directly connecting the motor 457 to the shaft part 451 not via the chain 453 or by the control part 60 configured to turn the heat accumulation tank.

The control part 60 may be a sequencer, a programmable controller, or a CPU, for example. The control part 60 includes a timer, and can measure a period of time elapsed after the switching, for example. The control part 60 drives the motor 457 so as to half-turn the turning part 452 after the lapse of the given period of time. That is, the control part 60 repeatedly carries out operation of half-turning the turning part 452 to switch between the heat accumulation tanks and then half-turning the turning part 452 after the lapse of the given period of time since the switching. The given period of time in this case may be 30 seconds to five minutes, for example. Note that, in a case of the configuration illustrated in FIG. 5 including the heat accumulation tanks each having an internal space filled with, e.g., a honeycomb serving as the heat accumulation bodies or in a case of the configuration illustrated in FIG. 8, the control part 60 may turn the turning part 452 constantly at one rpm in a certain direction. The control part 60 may turn, by batch processing, the turning part 452 by a given degrees, e.g., 30 degrees, 45 degrees, 60 degrees, 90 degrees, or 180 degrees.

The exhaust gas flows toward the turning part 452 along a direction indicated by the arrow E in FIG. 5. Then, the exhaust gas flows through the hollow part of the turning part 452, and is directed to the duct 2 along a direction indicated by the arrow F. Meanwhile, the air flows in a direction opposite to the direction indicated by the arrows E and F. Specifically, the air flows toward the turning part 452 along a direction indicated by the arrow G. Then, the air flows through the hollow part of the turning part 452, and is directed to the prime mover 20 along a direction indicated by the arrow H.

Figure 9:
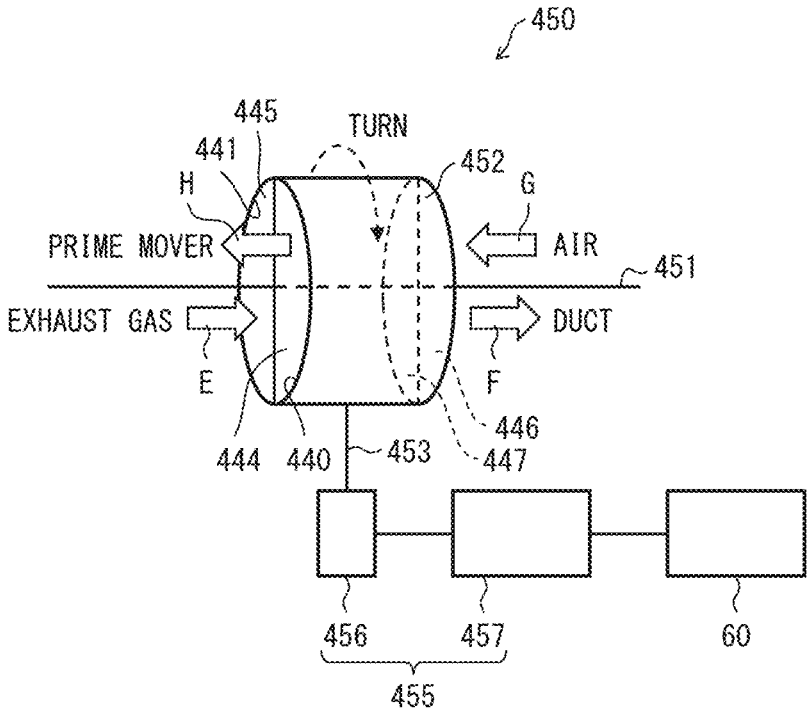
FIG. 9 is an explanatory view illustrating the switching mechanism of FIG. 5 having been half-turned.

Next, the following will provide a detailed description of operation of the thermoacoustic refrigerator in accordance with Embodiment 4, with reference to FIGS. 5 and 9. First, as illustrated in FIG. 5, the exhaust gas is supplied to the first opening 444, so that the heat of the exhaust gas is accumulated in the heat accumulation bodies 43 in the first heat accumulation tank 440. Meanwhile, the air is supplied to the fourth opening 447 of the second heat accumulation tank 441 at a given airflow rate.

Next, the control part 60 half-turns the turning part 452. In the half-turned state illustrated in FIG. 9, the air supplied to the first heat accumulation tank 440 via the third opening 446 at the given airflow rate carries out heat exchange with the heat accumulation bodies 43 in the first heat accumulation tank 440 and is consequently heated, and the heat accumulation bodies 43 in the first heat accumulation tank 440 loses heat and is consequently cooled. The air supplied at the given airflow rate and heated is discharged toward the prime mover 20 via the first opening 444.

Meanwhile, the exhaust gas is supplied to the second opening 445 of the second heat accumulation tank 441, so that the heat accumulation bodies 43 in the second heat accumulation tank 441 are heated again.

With the thermoacoustic refrigerator in accordance with Embodiment 4, thanks to the control part 60 that drives the driving part 445 to turn the turning part 452, it is possible to switch between the plural heat accumulation tanks 440 and 441 in an easy and simple manner. In addition, with the thermoacoustic refrigerator in accordance with Embodiment 4, it is possible to use, as the heat source, the air supplied at the given airflow rate and heated to a high-temperature as a result of heat exchange taken place in the heat accumulation tanks 440 and 441.

Moreover, the thermoacoustic refrigerator in accordance with Embodiment 4 may heat, with use of the air heated to a high temperature in a similar manner, a heat transfer oil or a liquid heating medium of another kind and may use, as the heat source, the heat transfer oil or liquid heating medium thus heated. Furthermore, the thermoacoustic refrigerator in accordance with Embodiment 4 may include a temperature sensor provided at or in the vicinity of the heat source, and may turn the plurality of heat accumulation tanks in accordance with the detection result from the temperature sensor.

In addition, with the thermoacoustic refrigerator in accordance with Embodiment 4, it is possible to set a suitable ratio between the opening areas of the heat accumulation tanks 440 and 441 according to the ratio between the airflow rates of the exhaust gas and the air. Thanks to the suitable area ratio, it is possible to collect the heat from the exhaust gas at a maximum efficiency and to use the collected heat as the heat source of the prime mover. Consequently, with the thermoacoustic refrigerator in accordance with Embodiment 4, it is possible to obtain a stable output in accordance with the ratio between the opening areas.

With the thermoacoustic refrigerator in accordance with the variation of Embodiment 4, the partition walls 449, by which the through-holes 448 are surrounded, store the heat therein, and accordingly the plural through-holes 448 function like a single heat accumulation tank. Furthermore, the partition walls 449 prevent mixing of the exhaust gas and the air. The exhaust gas and the air pass through the through-holes 448, so as to carry out heat exchange.

Embodiment 5

Figure 10:
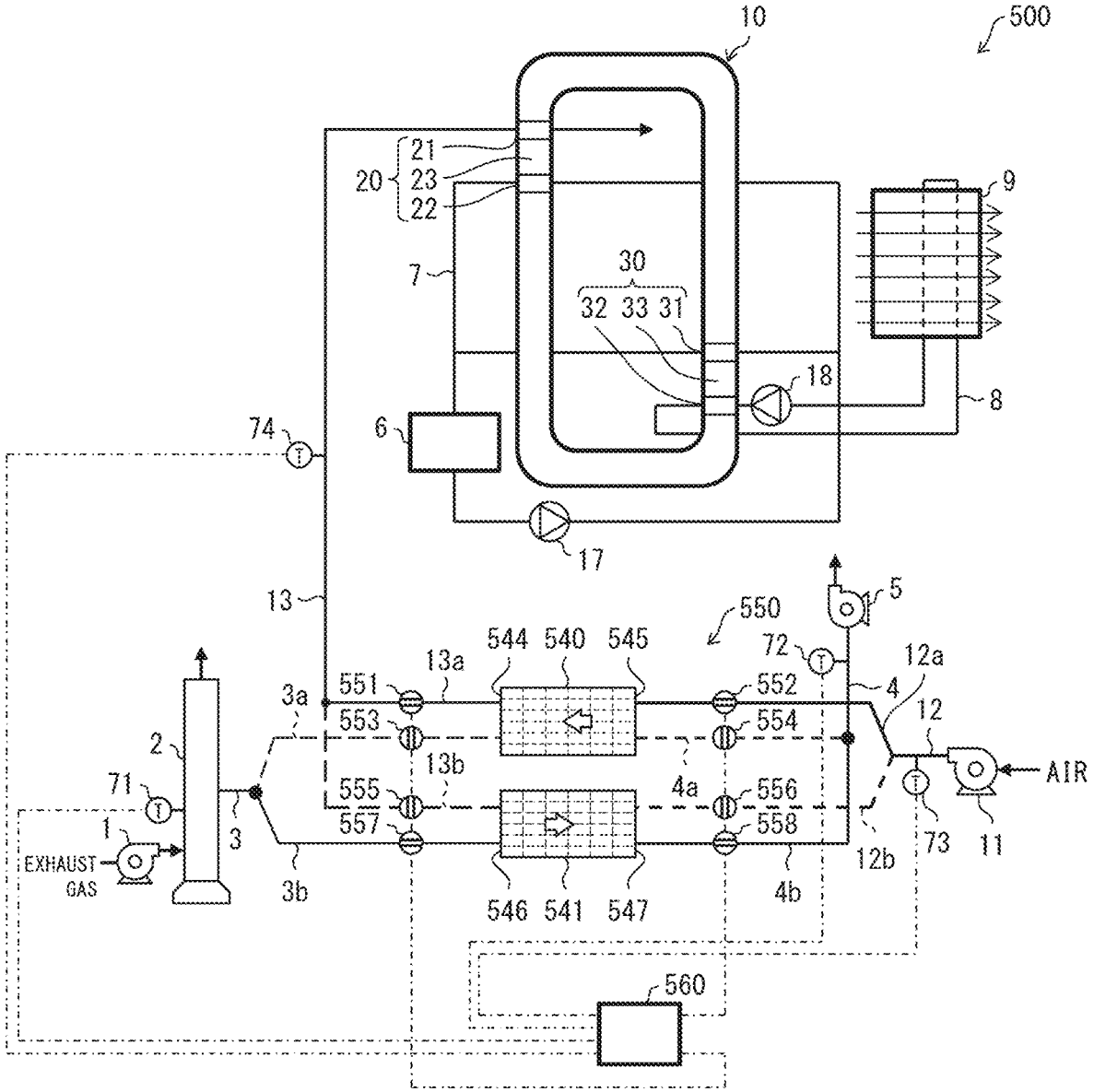
FIG. 10 is a view schematically illustrating a configuration of a thermoacoustic refrigerator in accordance with Embodiment 5.

A thermoacoustic refrigerator 500 in accordance with Embodiment 5 employs, as one example of the switching mechanism of Embodiment 3, a switching mechanism 550 employing the switching-valve method. As illustrated in FIG. 10, the thermoacoustic refrigerator 500 includes an air column pipe 10, a prime mover 20, a load 30, a first heat accumulation tank 540, a second heat accumulation tank 541, a switching mechanism 550, a control part 560, and a plurality of temperature sensors 71 to 74. Note that parts corresponding to those in FIGS. 1 to 4 are indicated by the same reference signs, and explanations thereof are omitted as appropriate.

The first heat accumulation tank 540 and the second heat accumulation tank 541 correspond to the first heat accumulation tank 240 and the second heat accumulation tank 241 of Embodiment 2. However, connections between the heat accumulation tanks and pieces of piping in Embodiment 5 are different from those in Embodiment 2.

Supply piping 3 of Embodiment 5 is branched into first supply piping 3*a* and second supply piping 3*b*. The first supply piping 3*a* is connected to a first side 544 of the first heat accumulation tank 540. The second supply piping 3*b* is connected to a first side 546 of the second heat accumulation tank 541.

Exhaust piping 4 of Embodiment 5 is achieved by merging of first exhaust piping 4*a*, which is connected to a second side 545 of the first heat accumulation tank 540, and second exhaust piping 4*b*, which is connected to a second side 547 of the second heat accumulation tank 541.

Fluid piping 12 of Embodiment 5 is branched into first fluid piping 12*a* and second fluid piping 12*b*. The first fluid piping 12*a* is connected to a second side 545 of the first heat accumulation tank 540. The second fluid piping 12*b* is connected to a second side 547 of the second heat accumulation tank 541.

Heat source piping 13 of Embodiment 5 is achieved by merging of first heat source piping 13*a*, which is connected to the first side 544 of the first heat accumulation tank 540, and second heat source piping 13*b*, which is connected to the first side 546 of the second heat accumulation tank 541.

The switching mechanism 550 is made of a plurality of switching valves. Each switching valve may be a poppet-type or butterfly-type switching damper, for example. A first switching valve 551 is provided to the first heat source piping 13*a*. A second switching valve 552 is provided to the first fluid piping 12*a*. A third switching valve 553 is provided to the first supply piping 3*a*. A fourth switching valve 554 is provided to the first exhaust piping 4*a*. A fifth switching valve 555 is provided to the second heat source piping 13*b*. A sixth switching valve 556 is provided to the second fluid piping 12*b*. A seventh switching valve 557 is provided to the second supply piping 3*b*. An eighth switching valve 558 is provided to the second exhaust piping 4*b*.

The plurality of switching valves carry out switching to select which of the plurality of heat accumulation tanks is connected to the supply piping 3 and the exhaust piping 4 and which of the plurality of heat accumulation tanks is connected to the fluid piping 12 and the heat source piping 13.

The control part 560 controls opening and closing of the plurality of switching valves. Examples of the control part 560 encompass a sequencer, a temperature adjustment system switch, a programmable controller, and an MPU. The control part 560 includes a timer, and can measure a period of time elapsed after the switching, for example. In addition, the control part 560 receives measurement data obtained by the temperature sensors 71 to 74, and can measure temperatures of an exhaust gas and air.

The control part 560 controls opening and closing of the plurality of switching valves to carry out switching between the plurality of heat accumulation tanks so that the first heat accumulation tank 540 to which the supply piping 3 and the exhaust piping 4 are connected and the second heat accumulation tank 541 to which the fluid piping 12 and the heat source piping 13 are connected are switched to each other.

The temperature sensor 71 is provided to the duct 2 or the supply piping 3, and the temperature sensor 72 is provided to the exhaust piping 4. Thus, it is possible to measure the temperature of the exhaust gas discharged from the heat accumulation tank after being supplied to the heat accumulation tank.

The temperature sensor 73 is provided to the fluid piping 12. The temperature sensor 74 is provided to the heat source piping 13. Thus, it is possible to measure the temperature of the air supplied to the prime mover 20 after being supplied to the heat accumulation tank and then discharged from the heat accumulation tank.

In accordance with the thermoacoustic refrigerator 500, the control part 560 carries out the switching operation in the following manner. First, the control part 560 opens the first switching valve 551 and the second switching valve 552, and closes the third switching valve 553 and the fourth switching valve 554. At the same time, the control part 560 closes the fifth switching valve 555 and the sixth switching valve 556, and opens the seventh switching valve 557 and the eighth switching valve 558. Consequently, the air that is a second heating medium is supplied to the second side 545 of the first heat accumulation tank 540, and is heated as a result of heat exchange with heat accumulation bodies 43 filled in the first heat accumulation tank 540. Thereafter, the air that is the second heating medium is discharged from the first side 544 of the first heat accumulation tank 540.

Meanwhile, the exhaust gas that is a first heating medium is supplied to the first side 546 of the second heat accumulation tank 541, and heats heat accumulation bodies 43 filled in the second heat accumulation tank 541 as a result of heat exchange with the heat accumulation bodies 43. Thereafter, the exhaust gas that is the first heating medium is discharged from the second side 547 of the second heat accumulation tank 541.

After the lapse of a given period of time since the switching, the control part 560 carries out switching between the plural heat accumulation tanks 540 and 541 so that the second heat accumulation tank 541 to which the exhaust gas is to be supplied and the first heat accumulation tank 540 to which the air is to be supplied are switched to each other. The given period of time is a period of time taken until the temperatures of the exhaust gas and the air measured at or near the inlet and outlet via the plural temperature sensors 71 to 74 and a temperature difference between these temperatures reach given values again. After the given period of time has elapsed, the control part 560 closes the first switching valve 551, the second switching valve 552, the seventh switching valve 557, and the eighth switching valve 558, and opens the third switching valve 553, the fourth switching valve 554, the fifth switching valve 555, and the sixth switching valve 556, reversely to the above.

As a result, the exhaust gas is supplied to the first heat accumulation tank 540. Thus, heat exchange is carried out between the exhaust gas and the heat accumulation bodies having been cooled as a result of heat deprival in heat exchange with the air taken place before the switching operation. Consequently, the heat accumulation bodies are heated. At the same time, the air is supplied to the second heat accumulation tank 541. Thus, heat exchange is carried out between the air and the heat accumulation bodies having been heated as a result of heat exchange with the exhaust gas taken place before the switching operation. Consequently, the air is heated.

After that, the above-described switching operation is repeated every time the given period of time has elapsed.

Note that the control part 560 may carry out the switching control simply when the temperature of the air measured via the temperature sensor 74 provided to the heat source piping 13 drops to a given temperature. Specifically, the given temperature is a minimum temperature required to cause self-oscillation of a working fluid in the prime mover 20, and may be 100° C., for example. Further alternatively, the control part 560 may carry out the switching control simply when the period of time elapsed since the last switching is determined to reach a given period of time (e.g., one minute) on the basis of the input value from the timer.

With the thermoacoustic refrigerator 500, the control part 560 can control the plurality of switching valves to switch between the first heat accumulation tank 540 and the second heat accumulation tank 541 while fixing the first heat accumulation tank 540 and the second heat accumulation tank 541 without moving the first heat accumulation tank 540 and the second heat accumulation tank 541. In addition, with the thermoacoustic refrigerator 500, it is easy to carry out the switching between the plurality of heat accumulation tanks. In the example explained in Embodiment 5, the number of heat accumulation tanks is two. However, even in cases where the number of heat accumulation tanks is three or more, the configuration of Embodiment 5 enables easy adjustment of switching between these heat accumulation tanks in a manner suitable to the number of heat accumulation tanks.

Furthermore, with the thermoacoustic refrigerator 500, it is possible to carry out the switching at a short cycle, e.g., every one minute. In this case, since the switching is carried out at a short cycle, a total amount of heat exchanged per switching is relatively small. Therefore, it is possible to reduce the amount of heat accumulation bodies to be filled in the heat accumulation tank, thereby reducing the size of the heat accumulation tank. Meanwhile, with the thermoacoustic refrigerator 500, it is possible to carry out the switching at a long cycle, e.g., every approximately an hour to two hours. Thus, with the thermoacoustic refrigerator 500, it is possible to carry out the switching either at a short cycle or at a long cycle. In addition, with the thermoacoustic refrigerator 500, it is possible to change, with the control part 560, the operational frequency of the blower so as to adjust the airflow rates of the exhaust gas and the air flowing through the heat accumulation tanks.

Furthermore, with the thermoacoustic refrigerator 500, in a case where the cold heat output from the load 30 is not necessary, it is possible to close four switching valves (551, 552, 555, 556) to supply the exhaust gas to one or two heat accumulation tanks so that the heat accumulation bodies are heated. In addition, if the supply of the exhaust gas is stopped, the thermoacoustic refrigerator 500 can supply the heated air to the prime mover 20 in the following manner. That is, for example, the control part 560 closes four switching valves (553, 554, 557, 558) and opens two switching valves, specifically, the first switching valve 551 and second switching valve 552 or the fifth switching valve 555 and sixth switching valve 556.

Embodiment 6

Figure 11:
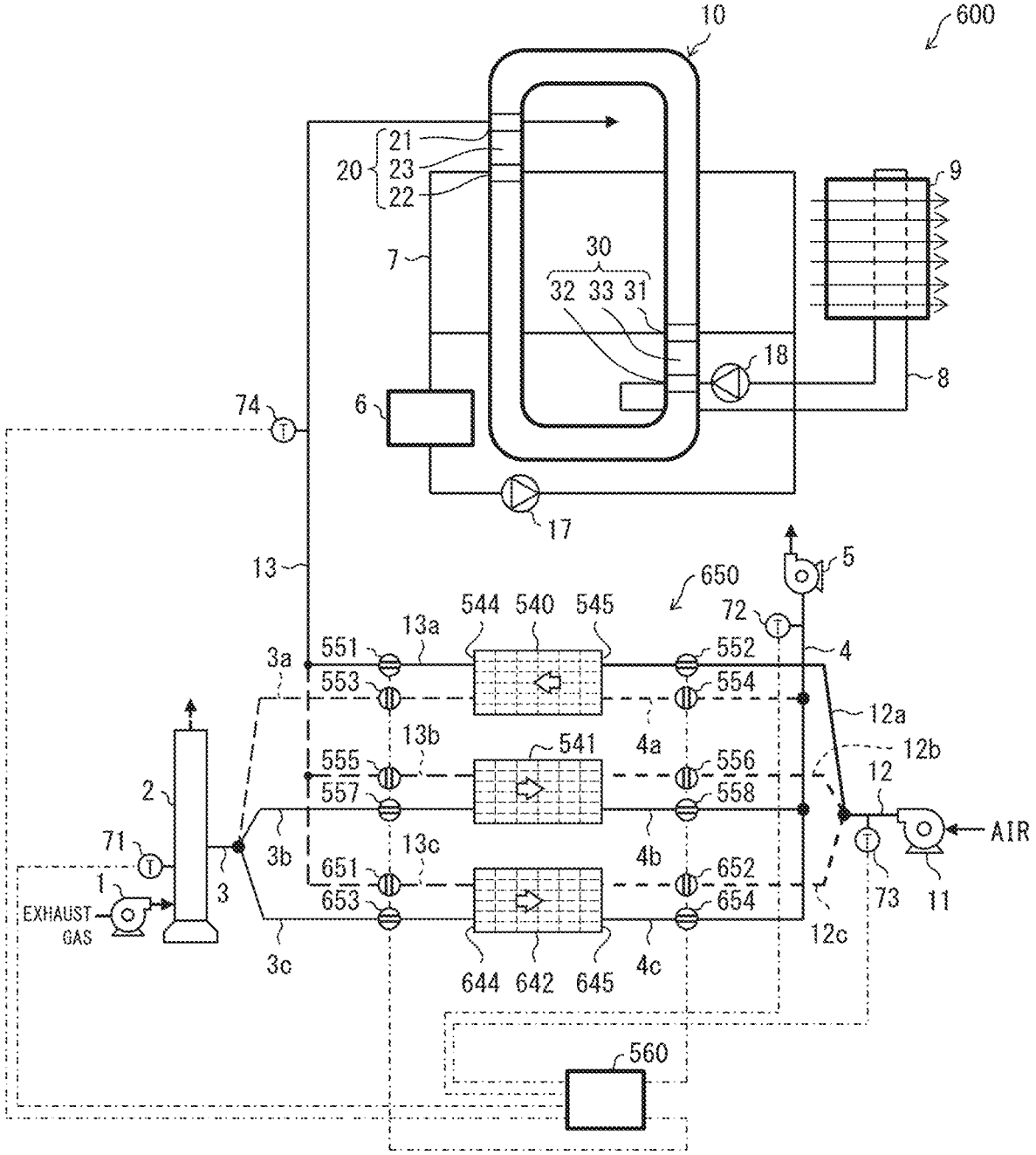
FIG. 11 is a view schematically illustrating a configuration of a thermoacoustic refrigerator in accordance with Embodiment 6.

A thermoacoustic refrigerator 600 in accordance with Embodiment 6 includes, as the plural heat accumulation tanks, three heat accumulation tanks. As illustrated in FIG. 11, the thermoacoustic refrigerator 600 includes an air column pipe 10, a prime mover 20, a load 30, a first heat accumulation tank 540, a second heat accumulation tank 541, a third heat accumulation tank 642, a switching mechanism 650, a control part 560, and a plurality of temperature sensors 71 to 74. Note that parts corresponding to those in FIGS. 1 to 5 are indicated by the same reference signs, and explanations thereof are omitted as appropriate.

The third heat accumulation tank 642 corresponds to each of the first heat accumulation tank 540 and the second heat accumulation tank 541 of Embodiment 5. However, connections between the heat accumulation tanks and pieces of piping in Embodiment 6 are different from those in Embodiment 5.

Specifically, the supply piping 3 of Embodiment 6 is further branched into third supply piping 3*c*. The third supply piping 3*c* is connected to a first side 644 of the third heat accumulation tank 642.

In addition, third exhaust piping 4*c* is further merged into exhaust piping 4 of Embodiment 6. The third exhaust piping 4*c* is connected to a second side 645 of the third heat accumulation tank 642.

Furthermore, fluid piping 12 of Embodiment 6 is further branched into third fluid piping 12*c*. The third fluid piping 12*c* is connected to the second side 645 of the third heat accumulation tank 642.

Moreover, third heat source piping 13*c* is further merged into heat source piping 13 of Embodiment 6. The third heat source piping 13*c* is connected to the first side 644 of the third heat accumulation tank 642.

The switching mechanism 650 further includes a ninth switching valve 651, a tenth switching valve 652, an eleventh switching valve 653, and a twelfth switching valve 654. These switching valves have similar configurations to those of the plurality of switching valves of Embodiment 5. Each of these switching valves is a poppet-type switching damper or a butterfly-type switching damper, for example. The ninth switching valve 651 is provided to the third heat source piping 13*c*. The tenth switching valve 652 is provided to the third fluid piping 12*c*. The eleventh switching valve 653 is provided to the third supply piping 3*c*. The twelfth switching valve 654 is provided to the third exhaust piping 4*c*.

Locations of temperature sensors 71 to 74 of the thermoacoustic refrigerator 600 are identical to those of the temperature sensors 71 to 74 of Embodiment 5. That is, the temperature sensor 71 is provided to the duct 2 or the supply piping 3. The temperature sensor 72 is provided to the exhaust piping 4. The temperature sensor 73 is provided to the fluid piping 12, and the temperature sensor 74 is provided to the heat source piping 13.

The control part 560 measures, via the plurality of temperature sensors 71 to 74, temperatures of an exhaust gas and air and a difference between the temperature at or near inlets of the heat accumulation tanks and the temperature at or near outlets of the heat accumulation tanks. The control part 560 controls the plurality of switching valves in accordance with the temperatures at or near the inlets and outlets and a difference between these temperatures.

With the thermoacoustic refrigerator 600, which includes the three heat accumulation tanks, it is possible to reduce the resistance applied to the exhaust gas or the air passing through each heat accumulation tank, as compared to that in the configuration including two heat accumulation tanks. In addition, with the thermoacoustic refrigerator 600, it is possible to carry out the switching between the plural heat accumulation tanks at different timings, not at the same timing. Consequently, it is possible to reduce pressure changes caused by opening/closing of the switching valves. For example, the control part 560 and the switching mechanism 650 can carry out the following control.

In a first state of the thermoacoustic refrigerator 600, six switching valves (551, 552, 557, 558, 653, 654) are open, and the other six switching valves (553, 554, 555, 556, 651, 652) are closed, as illustrated in FIG. 11. Consequently, the air is supplied to the first heat accumulation tank 540. The exhaust gas is supplied to the second heat accumulation tank 541 and the third heat accumulation tank 642.

When the temperature of the air measured via the temperature sensor 74 drops to a given temperature in the first state, the control part 560 first opens two switching valves (555, 556) and closes two switching valves (557, 558). Consequently, the second heat accumulation tank 541 is supplied with the air, rather than the exhaust gas.

Subsequently, the control part 560 opens two switching valves (553, 554), and closes two switching valves (551, 552). Consequently, the first heat accumulation tank 540 is supplied with the exhaust gas, rather than the air. Then, the state transitions to a second state. At this time, the third heat accumulation tank 642 remains in the state in which the exhaust gas is supplied thereto.

Furthermore, when the temperature of the air measured via the temperature sensor 74 drops to the given temperature again in the second state, the control part 560 first opens two switching valves (651, 652) and closes two switching valves (653, 654). Consequently, the third heat accumulation tank 642 is supplied with the air, rather than the exhaust gas.

Subsequently, the control part 560 opens two switching valves (557, 558) and closes two switching valves (555, 556). Consequently, the second heat accumulation tank 541 is supplied with the exhaust gas again, rather than the air. Then, the state transitions to a third state. At this time, the first heat accumulation tank 540 remains in the state in which the exhaust gas is supplied thereto.

Furthermore, when the temperature of the air measured via the temperature sensor 74 drops to the given temperature again in the third state, the control part 560 first opens two switching valves (551, 552) and closes two switching valves (553, 554). Consequently, the first heat accumulation tank 540 is supplied with the air again, rather than the exhaust gas.

Subsequently, the control part 560 opens two switching valves (653, 654), and closes two switching valves (651, 652). Consequently, the third heat accumulation tank 642 is supplied with the exhaust gas again, rather than the air. Then, the state returns to the first state. At this time, the second heat accumulation tank 541 remains in the state in which the exhaust gas is supplied thereto.

After that, the above-described control may be repeated successively. Consequently, the air heated to a high temperature can be supplied to the prime mover 20 continuously and stably.

In accordance with the above-described configuration and control, the number of heat accumulation tanks through which the exhaust gas flows is twice as large as that of the configuration employing two heat accumulation tanks. Therefore, the resistance applied to the exhaust gas passing through each heat accumulation tank is substantially halved. Consequently, it is possible to reduce power consumption of the exhaust blower 5. Furthermore, it is possible to change the flow directions of the air and the exhaust gas even without completely interrupting the flows of the exhaust gas and the air. Rather, it is possible to change these flow directions while ensuring a flow path of at least one heat accumulation tank. This makes it possible to reduce pressure changes caused by switching operation of the switching valves.

[Variations]

The above-described embodiments have dealt with applications as coolers for cooling equipment and refrigeration equipment. However, this is not limitative. For example, the thermoacoustic refrigerator in accordance with each embodiment of the present application is applicable to automobiles, ships, and submarines. In addition, the above-described embodiments employ, as the heat source, the exhaust gas discharged from the duct 2. However, this is not limitative. Other examples of the heat source encompass sunlight and an exhaust gas from an automobile or the like. Also in accordance with any of these variations, it is possible to stabilize a cold heat output from a load, whereby a thermoacoustic refrigerator can operate stably.

In addition, the above-described embodiments employ, as the air column pipe, the noncircular single loop pipe. However, this is not limitative. For example, the air column pipe may be a straight pipe constituted by straight pipe parts, a circular single loop pipe, or a single loop pipe including a pair of straight pipe parts. For another example, the air column pipe may be a so-called double loop pipe including: two loop pipes coupled to each other via piping; and a prime mover and a load respectively disposed in the two loop pipes.

In addition, in the case where the air column pipe is the loop pipe, the prime mover and the load may be respectively disposed in the straight pipe parts that constitute a pair such that the prime mover and the load are arranged in an asymmetric manner, in a line symmetric manner, or a center-point symmetric manner (approximately 180°). Moreover, in the examples illustrated in the above-described embodiments, one prime mover and one load are disposed inside the air column pipe. Alternatively, a plurality of prime movers and a plurality of loads may be provided therein. Note that the number of prime movers does not necessarily need to be identical to the number of loads. For example, three prime movers and one load may be provided.

In the configurations illustrated in the above-described embodiments, the exhaust gas or the air discharged from the heat accumulation tank is directly supplied to the prime mover. However, this is not limitative. Alternatively, for example, a heat exchanger for a heating medium may be provided between the heat accumulation tank and the prime mover. Then, the heat exchanger for the heating medium may receive the heat of the exhaust gas or the air, and may supply, to the prime mover, a heat transfer oil or a liquid heating medium of another kind having been heated. Employing the heat transfer oil or the liquid heating medium of another kind as the heat source makes it possible to reduce the size of the prime-mover-side high-temperature heat exchanger and to provide a more stable output, since a liquid can transfer a greater amount of heat more stably with a smaller amount than a gas.

In addition, the above-described embodiments employ the exhaust gas as the first heating medium, and employ the air as the second heating medium. However, this is not limitative. The second-heating-medium blower 11 may be of any type, provided that an output at a given airflow rate can be achieved with it.

The number of heat accumulation tanks that can be switched by the switching mechanism is preferably two or three. In the examples shown in FIGS. 3 to 6, 9, and 10, the number of heat accumulation tanks is two. However, this is not limitative. Alternatively, the number of heat accumulation tanks may be three. The plurality of heat accumulation tanks of Embodiment 2 may be used without any limitation on the number of heat accumulation tanks.

The temperature sensors may be of any type, provided that they are disposed at or near the inlet and outlet of the heat accumulation tank, and is not limited to the ones in the above-described embodiments. For example, the temperature sensors may be provided at first and second ends of each heat accumulation tank.

Each of the control parts 60 and 560 may be of any type, provided that it can control opening/closing of the plurality of switching valves so as to carry out switching between the plurality of heat accumulation tanks so that the first heat accumulation tank to which the supply piping and the exhaust piping are connected and the second heat accumulation tank to which the fluid piping and the heat source piping are connected are switched to each other. The control parts 60 and 560 are not limited to the configurations described in the above-described embodiments.

Aspects of the present invention can also be expressed as follows:

A thermoacoustic refrigerator in accordance with a first aspect of the present invention includes: an air column pipe filled with a working gas; a prime mover disposed inside the air column pipe and configured to generate sound waves; a load disposed inside the air column pipe and configured to output cold heat; and at least one heat accumulation tank having an internal space provided with a heat accumulation body, said at least one heat accumulation tank being connectable to the prime mover, the prime mover being connected to said at least one heat accumulation tank, said at least one heat accumulation tank receiving a first heating medium supplied thereto, said at least one heat accumulation tank discharging and supplying, to the prime mover, the first heating medium having undergone heat exchange so that self-oscillation of the working gas is caused and sound waves are generated in the prime mover, the load being operated by the sound waves thus generated.

Here, the heat accumulation tank has the internal space provided with the heat accumulation body, and is configured to be connected to the prime mover. In this case, for example, the prime mover is connected to the heat accumulation tank, and the heating medium is supplied to the heat accumulation tank. Then, the heating medium discharged from the heat accumulation tank after heat exchange may be directly supplied to the prime mover. Alternatively, the heat of the heating medium discharged from the heat accumulation tank may be received by an additional heat exchanger, and a heat transfer oil or a liquid of another kind heated by the additional heat exchanger may be supplied to the prime mover.

With the thermoacoustic refrigerator in accordance with the first aspect, the first heating medium is supplied to the heat accumulation tank, and the temperature of the first heating medium passing through the heat accumulation tank can be stabilized by the heat accumulated in the heat accumulation body. This leads to little changes in the output of the heat source discharged from the heat accumulation tank toward the prime mover, thereby stabilizing a cold heat output. Consequently, the thermoacoustic refrigerator can operate stably. In addition, it is possible to deal with changes in the temperature of the heating medium.

A thermoacoustic refrigerator in accordance with a second aspect of the present invention includes: an air column pipe filled with a working gas; a prime mover disposed inside the air column pipe and configured to generate sound waves; a load disposed inside the air column pipe and configured to output cold heat; and at least one heat accumulation tank having an internal space provided with a heat accumulation body, said at least one heat accumulation tank being connectable to the prime mover, the prime mover being connected to said at least one heat accumulation tank having received a first heating medium supplied thereto and having accumulated heat therein, said at least one heat accumulation tank having accumulated the heat therein receiving a second heating medium supplied thereto at a given airflow rate, said at least one heat accumulation tank supplying, to the prime mover, the second heating medium heated as a result of heat exchange so that self-oscillation of the working gas is caused and sound waves are generated in the prime mover, the load being operated by the sound waves thus generated.

Here, the second heating medium does not necessarily need to be heated preliminarily, unlike the first heating medium. Regarding the heat source, the second heating medium heated to a high temperature as result of heat exchange in the heat accumulation tank may be directly supplied to the prime mover. Alternatively, the heat of the second heating medium heated to a high temperature as result of heat exchange in the heat accumulation tank may be received by an additional heat exchanger, and a heat transfer oil or a liquid of another kind heated by the additional heat exchanger may be supplied to the prime mover.

With the thermoacoustic refrigerator in accordance with the second aspect, it is possible to stabilize the airflow rate of the high-temperature second heating medium discharged from the heat accumulation tank, even when the airflow rate (mass flow rate) of the first heating medium changes. This leads to little changes in the output of the heat source discharged from the heat accumulation tank toward the prime mover, thereby stabilizing a cold heat output. Consequently, the thermoacoustic refrigerator can operate stably. In addition, it is also possible to deal with a case where the supply of the first heating medium is completely stopped.

A thermoacoustic refrigerator in accordance with a third aspect of the present invention may be the thermoacoustic refrigerator recited in the second aspect configured such that said at least one heat accumulation tank comprises a plurality of heat accumulation tanks that are to be used as a heat source successively in order, and the thermoacoustic refrigerator further comprises a switching mechanism capable of carrying out switching between the plurality of heat accumulation tanks so that a first one of the plurality of heat accumulation tanks to which the first heating medium is to be supplied and a second one of the plurality of heat accumulation tanks to which the second heating medium is to be supplied are switched to each other.

With this configuration, it is possible to carry out the switching in an easy and simple manner, even when the frequency of the switching is increased.

A thermoacoustic refrigerator in accordance with a fourth aspect of the present invention may be the thermoacoustic refrigerator recited in the third aspect configured such that the switching mechanism includes: a turning part turnable around a shaft part; and a driving part configured to turn the turning part, and the plurality of heat accumulation tanks and the turning part are integrated with each other.

With this configuration, it is possible to carry out the switching in an easy and simple manner by turning the turning part with the driving part. In addition, it is possible to use, as the heat source, the output from the heat accumulation tank by making use of the second heating medium having undergone heat exchange in the heat accumulation tank or by heating a heat transfer oil or a liquid heating medium of another kind with the second heating medium having undergone heat exchange. Also, it is possible to carry out the turning operation in accordance with the detection result obtained by a temperature sensor disposed at or in the vicinity of the heat source. Employing, as the heat source, the heat transfer oil or the liquid heating medium of another kind can provide a more stable output, since a liquid can transfer a greater amount of heat more stably with a smaller amount than a gas.

A thermoacoustic refrigerator in accordance with a fifth aspect of the present invention may be the thermoacoustic refrigerator recited in the fourth aspect configured such that a ratio between areas of openings of the plurality of heat accumulation tanks is set in accordance with a ratio between airflow rates of the first heating medium and the second heating medium.

In this case, it is possible to suitably set the ratio between the areas of the openings of the heat accumulation tanks in accordance with the ratio between the airflow rate (e.g., 50 $m^3$/min to 1,000 $m^3$/min) of the first heating medium and the airflow rate (e.g., 5 $m^3$/min to 100 $m^3$/min) of the second heating medium. Thus, it is possible to obtain a stable output according to the area ratio.

A thermoacoustic refrigerator in accordance with a sixth aspect of the present invention may be the thermoacoustic refrigerator recited in the third aspect configured such that the thermoacoustic refrigerator may further include: supply piping and exhaust piping with which the first heating medium is caused to pass through the first heat accumulation tank; and fluid piping and heat source piping with which the second heating medium is caused to pass through the second heat accumulation tank, wherein the switching mechanism includes: a plurality of switching valves configured to carry out switching to select which of the plurality of heat accumulation tanks is connected to the supply piping and the exhaust piping and which of the plurality of heat accumulation tanks is connected to the fluid piping and the heat source piping; and a control part configured to control opening and closing of the plurality of switching valves to carry out switching between the plurality of heat accumulation tanks so that the first one of the plurality of heat accumulation tanks to which the supply piping and the exhaust piping are connected and the second one of the plurality of heat accumulation tanks to which the fluid piping and the heat source piping are connected are switched to each other.

With the thermoacoustic refrigerator in accordance with the sixth aspect, it is possible to switch between the switching at a short cycle and the switching at a long cycle. In a case where the switching at a short cycle is employed, it is possible to reduce the size of the heat accumulation tank.

A thermoacoustic refrigerator in accordance with a seventh aspect of the present invention may be the thermoacoustic refrigerator recited in the sixth aspect configured such that the thermoacoustic refrigerator may further include: a temperature sensor disposed at or near inlets of the plurality of heat accumulation tanks and a temperature sensor disposed at or near outlets of the plurality of heat accumulation tanks, wherein the control part is further configured to control the plurality of switching valves in accordance with a period of time elapsed after switching, temperatures measured at or near the inlets and the outlets by the temperature sensors, and a temperature difference between the temperatures.

With this configuration, it is possible to easily manage the degree of the heat accumulation and/or the temperature of the second heating medium having been discharged.

The present invention is not limited to the embodiments, but can be altered by a skilled person in the art within the scope of the claims. The present invention also encompasses, in its technical scope, any embodiment derived by combining technical means disclosed in differing embodiments. Further, it is possible to form a new technical feature by combining the technical means disclosed in the respective embodiments.

For example, the working gas filled in the air column pipe is not limited to helium as in the above-described embodiments. Alternatively, the working gas may be nitrogen, argon, a mixture gas of plural kinds of gases such as helium and argon, or air.

The number of heat accumulation tanks may be one or two or more. The heat accumulation tank may be shaped in a cube, a cuboid, or a circular cylinder. The heat accumulation tank may be a 20-feet container or 1-$m^3$ duct, for example. The heat accumulation tank may have a circular cylindrical shape structured as in Embodiment 4.

The shape, material, structure of the heat accumulation bodies are not limited to those of the above-described embodiments, and may arbitrarily be selected, provided that the heat accumulation bodies with them can achieve a resistance to a given temperature, that is, the heat accumulation bodies with them can keep the shape at a given temperature.

REFERENCE SIGNS LIST

2 Duct
3 Supply piping
3*a* First supply piping
3*b* Second supply piping
3*c* Third supply piping
4 Exhaust piping
4*a* First exhaust piping
4*b* Second exhaust piping
4*c* Third exhaust piping
12 Fluid piping
12*a* First fluid piping
12*b* Second fluid piping
12*c* Third fluid piping
13 Heat source piping
13*a* First heat source piping
13*b* Second heat source piping
13*c* Third heat source piping
10 Air column pipe
20 Prime mover
30 Load
40, 240, 241, 440, 441, 443, 540, 541, 642 Heat accumulation tank
240, 440, 540 First heat accumulation tank
241, 441, 541 Second heat accumulation tank
40*a* Internal space
43 Heat accumulation body
50, 450, 550, 650 Switching mechanism
60, 560 Control part
71, 72, 73, 74 Temperature sensor
100, 200, 300, 500, 600 Thermoacoustic refrigerator
551 First switching valve
552 Second switching valve
553 Third switching valve
554 Fourth switching valve
555 Fifth switching valve
556 Sixth switching valve
557 Seventh switching valve
558 Eighth switching valve
651 Ninth switching valve
652 Tenth switching valve
653 Eleventh switching valve
654 Twelfth switching valve

The invention claimed is:

1. A thermoacoustic refrigerator comprising:
an air column pipe filled with a working gas;
a prime mover disposed inside the air column pipe and configured to generate sound waves;
a load disposed inside the air column pipe and configured to output cold heat; and
at least one heat accumulation tank having an internal space provided with a heat accumulation body, said at least one heat accumulation tank being connectable to the prime mover,
the prime mover being connected to said at least one heat accumulation tank,
said at least one heat accumulation tank receiving a first heating medium supplied thereto, said at least one heat accumulation tank discharging and supplying, to the prime mover, the first heating medium having undergone heat exchange so that self-oscillation of the working gas is caused and sound waves are generated in the prime mover,
the load being operated by the sound waves thus generated.

2. A thermoacoustic refrigerator comprising:
an air column pipe filled with a working gas;
a prime mover disposed inside the air column pipe and configured to generate sound waves;
a load disposed inside the air column pipe and configured to output cold heat; and
at least one heat accumulation tank having an internal space provided with a heat accumulation body, said at least one heat accumulation tank being connectable to the prime mover,
the prime mover being connected to said at least one heat accumulation tank having received a first heating medium supplied thereto and having accumulated heat therein,
said at least one heat accumulation tank having accumulated the heat therein receiving a second heating medium supplied thereto at a given airflow rate, said at least one heat accumulation tank supplying, to the prime mover, the second heating medium heated as a result of heat exchange so that self-oscillation of the working gas is caused and sound waves are generated in the prime mover,
the load being operated by the sound waves thus generated.

3. The thermoacoustic refrigerator as set forth in claim 2, wherein
said at least one heat accumulation tank comprises a plurality of heat accumulation tanks that are to be used as a heat source successively in order, and
the thermoacoustic refrigerator further comprises a switching mechanism capable of carrying out switching between the plurality of heat accumulation tanks so that a first one of the plurality of heat accumulation tanks to which the first heating medium is to be supplied and a second one of the plurality of heat accumulation tanks to which the second heating medium is to be supplied are switched to each other.

4. The thermoacoustic refrigerator as set forth in claim 3, wherein
the switching mechanism includes:
a turning part turnable around a shaft part; and a driving part configured to turn the turning part, and the plurality of heat accumulation tanks and the turning part are integrated with each other.

5. The thermoacoustic refrigerator as set forth in claim 4, wherein a ratio between areas of openings of the plurality of heat accumulation tanks is set in accordance with a ratio between airflow rates of the first heating medium and the second heating medium.

6. The thermoacoustic refrigerator as set forth in claim 3, further comprising:

supply piping and exhaust piping with which the first heating medium is caused to pass through the first heat accumulation tank; and fluid piping and heat source piping with which the second heating medium is caused to pass through the second heat accumulation tank, wherein the switching mechanism includes:

a plurality of switching valves configured to carry out switching to select which of the plurality of heat accumulation tanks is connected to the supply piping and the exhaust piping and which of the plurality of heat accumulation tanks is connected to the fluid piping and the heat source piping; and a control part configured to control opening and closing of the plurality of switching valves to carry out switching between the plurality of heat accumulation tanks so that the first one of the plurality of heat accumulation tanks to which the supply piping and the exhaust piping are connected and the second one of the plurality of heat accumulation tanks to which the fluid piping and the heat source piping are connected are switched to each other.

7. The thermoacoustic refrigerator as set forth in claim 6, further comprising:

a temperature sensor disposed at or near inlets of the plurality of heat accumulation tanks and a temperature sensor disposed at or near outlets of the plurality of heat accumulation tanks, wherein the control part is further configured to control the plurality of switching valves in accordance with a period of time elapsed after switching, temperatures measured at or near the inlets and the outlets by the temperature sensors, and a temperature difference between the temperatures.

* * * * *